United States Patent [19]

Goto et al.

[11] 4,278,746

[45] Jul. 14, 1981

[54] PHOTOSENSITIVE ELEMENTS FOR ELECTROPHOTOGRAPHY

[75] Inventors: Satoshi Goto; Yoshiaki Takei; Ichiro Imaho; Hiroyuki Nomori, all of Hino, Japan

[73] Assignee: Konishiroku Photo Industry Co., Ltd., Tokyo, Japan

[21] Appl. No.: 48,456

[22] Filed: Jun. 14, 1979

[30] Foreign Application Priority Data

Jun. 21, 1978 [JP] Japan ..... 53-75854

[51] Int. Cl.[3] ..... G03G 5/04

[52] U.S. Cl. ..... 430/59; 430/58

[58] Field of Search ..... 430/58, 59

[56] References Cited

U.S. PATENT DOCUMENTS 3,837,851 9/1974 Shattuck et al. ..... 430/59

*Primary Examiner*—Richard L. Schilling

*Attorney, Agent, or Firm*—Bierman & Bierman

[57] ABSTRACT

A photosensitive element for electrophotography which comprises a conductive support, a charge generating layer containing a charge generating substance, and a charge transporting layer. The element comprises a polymeric binder containing a charge transporting substance represented by the formula (I).

General formula (I)

wherein n represents 0 or 1, $R_1$, $R_2$ and $R_3$ each represent an aryl group, and $R_4$ and $R_5$ each represent a hydrogen, an alkyl group having 1–4 carbon atoms, an aryl group or an aralkyl group, provided that $R_4$ and $R_5$ are not simultaneously a hydrogen, and when n is 0, $R_4$ is not hydrogen.

8 Claims, 6 Drawing Figures

PHOTOSENSITIVE ELEMENTS FOR ELECTROPHOTOGRAPHY

Figure 1:
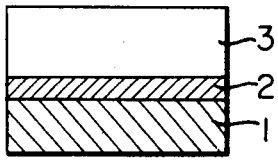

This invention relates to photosensitive elements for electrophotography. Particularly, the invention relates to photosensitive elements for electrophotography having a conductive support and thereon a layer comprising a charge generating substance on absorption of light, a charge transporting substance which is a novel pyrazoline compound and can be transporting the generated charge, and a polymeric binder.

Photosensitive elements for electrophotography depend for their photoconductivity on two processes, i.e. (1) a process for generating electrical charge on absorption of light, and (2) a process for transporting the generated charge. In the photosensitive elements according to the present invention, two different substances are alloted for the above-mentioned two processes, respectively. By virtue of this allotment, the photosensitive elements of the present invention possess such advantages that a range of choice of materials used therefor is broadened and consequently there can readily prepared photosensitive elements having any characteristics as desired in respect of electrophotographic characteristics such as sensitivity, acceptance potential, etc., and coat forming physical properties.

As an example of photosensitive elements having a layer containing a charge generating substance and a layer containing a charge transporting substance, respectively, there has been well known hitherto a photosensitive element comprising a charge generating layer containing amorphous selenium and thereon a charge transporting layer containing poly-N-vinylcarbazole.

Because of being a lack of flexibility of poly-N-vinylcarbazole, a layer comprising a poly-N-vinylcarbazole are hard, fragile, liable to cracking or peeling-off and poor in durability. When a plasticizer was incorporated into the layer in order to impart thereto appropriate flexibility, on that account, there was brought about such defect that residual potential increases and electrophotographic characteristics of as formation of fog in the resultant image, and so on is lowered.

Furthermore, considerable efforts have been exerted to obtain photosensitive elements for electrophotography with excellent electrophotographic characteristics and appropriate film strength by the use of low molecular weight organic compounds as charge transporting substances in combination with charge generating substance as desired and polymeric binders.

Selected and used as preferred low molecular weight charge transporting substances are, for example, oxadiazole derivatives such as 2,5-bis(p-diethylaminophenyl)-1,3,4-oxadiazole. These derivatives, however, have such defects that they are less compatible with polymeric binders and consequently liable to be crystallization, and also poor in heat stability.

As disclosed in U.S. Pat. No. 3,180,729, for example, it is a well-known technique to use pyrazoline compounds as photoconductive substances for photosensitive elements for electrophotography. Such compounds are not used therein as charge transporting substances which is covered with the responsibility of transporting the generated charge, but are used as both materials which generate electrical charge on absorption of light and which transport the generated charge.

On the other hand, it is also a well-known technique to use pyrazoline compounds as charge transporting substances as disclosed, for example, in U.S. Pat. No. 3,837,851. The pyrazoline compounds used therein, however, are less compatible with polymeric binders which are generally incorporated into a charge transporting layer in order to improve physical properties thereof, and when the polymeric binder is used in an amount necessary to obtain preferable physical properties, the used pyrazoline compound is therein crystallized thermally, with the result that the charge transporting layer becomes turbid and deteriorates in transmittance, and consequently the sensitivity of the resulting photosensitive element is lowered. The charge transporting layer which becomes turbid in the above manner is generally poor in homogeneity of the layer as well as stability as the layer, and further there is an observable tendency to poor charge characteristics. In the manner explained above, the fact is that in the preparation of photosensitive elements for electrophotography, no practicably preferable charge transporting substances have not been found yet.

An object of the present invention is to provide novel charge transporting substances excellent in compatibility with polymeric binders.

A further object of the present invention is to provide charge transporting layers high in film strength, homogeneous in structure and excellent in stability of the layer.

A still further object of the present invention is to provide photosensitive elements which are high in sensitivity and low in residual potential.

A still further object of the present invention is to provide photosensitive elements which are less in deterioration caused by fatigue when used in electrophotographic photosensitive element for repeated use.

The above-mentioned objects are accomplished by the use, as charge transporting substances, pyrazoline compounds represented by the following general formula [I].

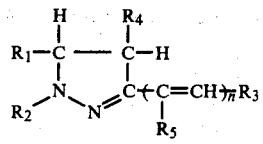

General formula (I)

wherein n represents a value of 0 or 1, $R_1$, $R_2$ and $R_3$ each represent an aryl group (e.g. a phenyl group), and $R_4$ and $R_5$ each represent a hydrogen, an alkyl group of 1 to 4 carbon atoms (e.g. a methyl group, an ethyl group), an aryl group (e.g. a phenyl group) or an aralkyl group (e.g. a benzyl group), provided that $R_4$ and $R_5$ are not simultaneously a hydrogen, and when n is a value of 0, $R_4$ is not a hydrogen.

These groups can also be modified to include at least one substituent which is preferably an electron donor having a negative Hammette's rule sigma value such as an amino, an alkoxy group, a dialkyl amino group, a diaryl amino group, an alkylaryl amino group, diaralkyl amino group, a monoalkyl amino group, a monoaryl amino group and a monoaralkyl amino group.

Preferable as the charge transporting substance for present invention represented by the following general formula [II].

General formula [II]

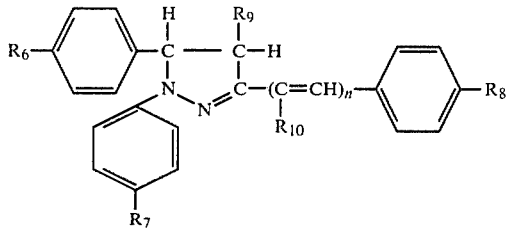

wherein n represents 0 or 1, $R_6$, $R_7$ and $R_8$ each represent a hydrogen, an amino, a dialkylamino, a diarylamino, a diaralkylamino or an alkoxy, and $R_9$ and $R_{10}$ each represent a hydrogen, an alkyl having 1–4 carbon atoms, an aryl group or an aralkyl group, provided that $R_9$ and $R_{10}$ are not simultaneously a hydrogen, and when n is 0, $R_9$ is not a hydrogen.

That is, by virtue of adopting the constitution as hereinbefore mentioned, on which the present invention is based, there can be obtained photosensitive elements for electrophotography which are excellent in property of being coated, durability, charge characteristics and low residual potential characteristics.

The pyrazoline compounds of the present invention represented by the aforesaid general formula [I] are excellently compatible with a variety of polymeric binders and do not become turbid or opaque even when a large quantity of a charge transporting substance to be incorporated into a polymeric binder is larger than that of the latter, with the result that the mixing ration of the polymeric binder to the charge transporting substance can greatly be broadened and thus photosensitive elements having preferable charge transporting ability and physical properties can be prepared. Because of excellent compatibility with high molecular binders of the charge transporting substances of the present invention, the resulting charge transporting layer is homogeneous and stable, and in consequence there can be obtained photosensitive elements which are excellent in sensitivity and charge characteristics but free from fog formation, and which are able to form sharp images with high density. Particularly, when the charge transporting substances of the present invention is used in electrophotography for repeated use, moreover, it is exhibit such an action and effect that no deterioration in ability caused by fatigue of the resultant elements is practically observed.

The pyrazoline compounds used as charge transporting substances in the present invention plays a role in injecting thereinto the electrical charge generated by a charge generating substance and in transporting the generated charge. On that account, the pyrazoline compounds in the present invention are preferably those in which at least one aryl group has been substituted with an electron donative group (a such substituent as having Hammette's sigma value being negative) such as an amino group, an dialkylamino group, a diarylamino group, a diaralkylamino group, an alkoxy group or the like group. In connection with reason in support of the above, it is presumed that because of these electron donative groups having an effect of lowering ionization potential of the pyrazoline compounds, these compounds pass easily through the electrical charge hole generated by a charge generating substance.

The pyrazoline compound of the aforesaid general formula [I] which are useful in the present invention includes, for example, those having their respective structures as exemplified below.

Exemplified compound:

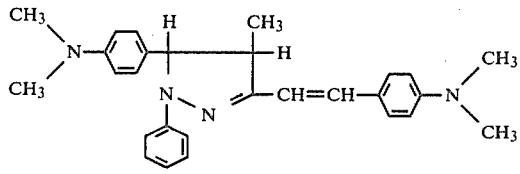

(1)

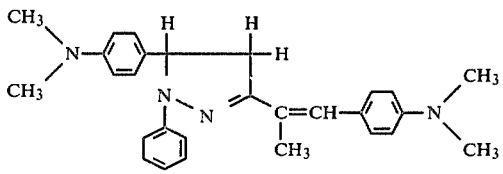

(2)

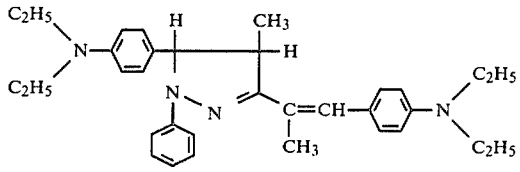

(3)

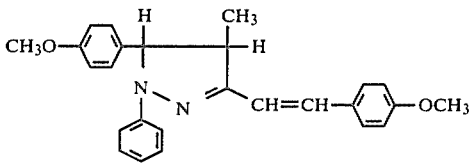

(4)

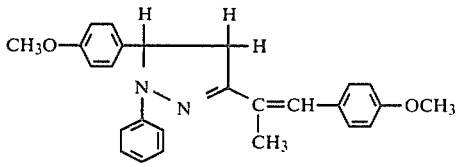

(5)

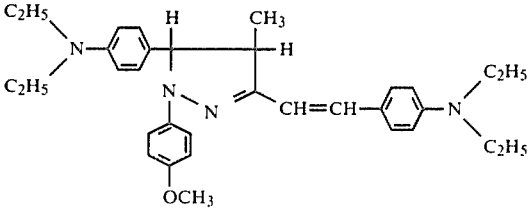

(6)

-continued

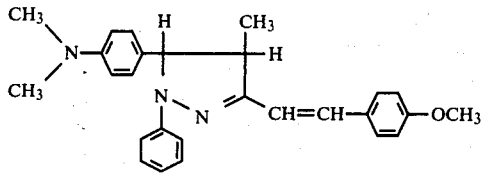

(7)

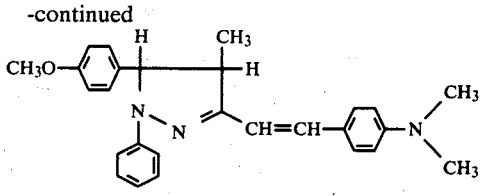

(8)

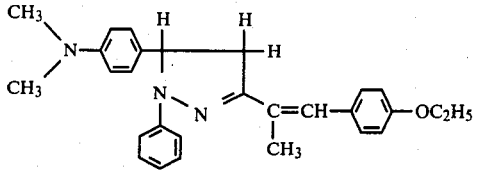

(9)

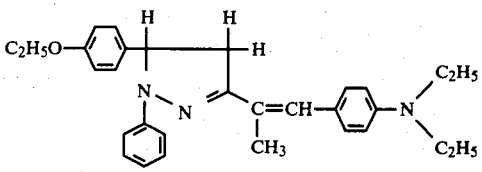

(10)

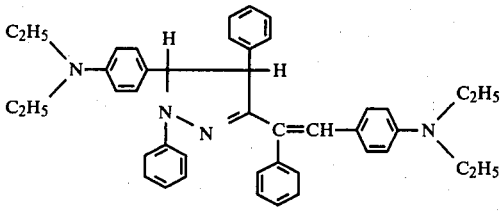

(11)

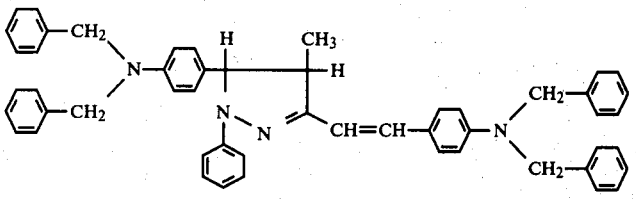

(12)

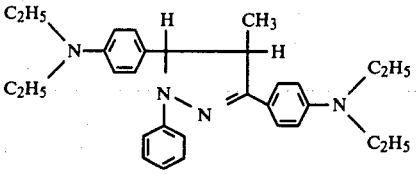

(13)

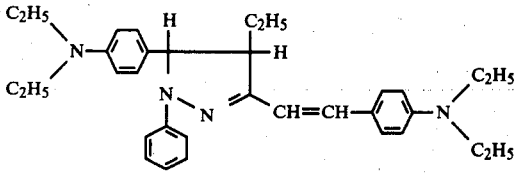

(14)

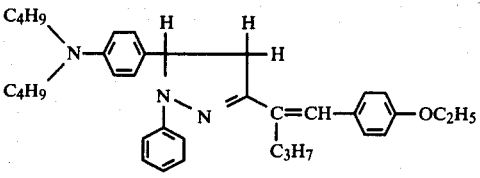

(15)

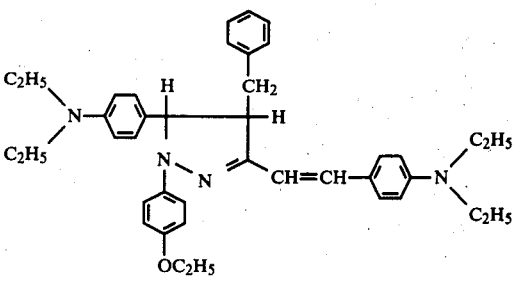

(16)

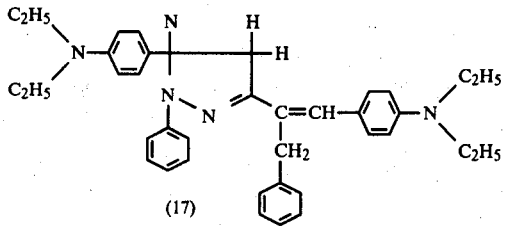

(17)

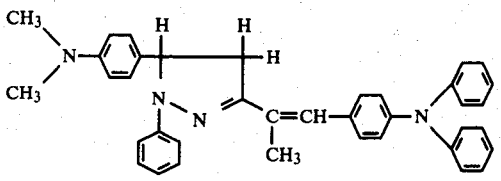

(18)

The above mentioned pyrazoline compounds used in the present invention may be synthesized according to known procedures, for example, dehydration condensation of $\alpha,\beta$-unsaturated ketone and phenylhydrazine in the presence of an acid catalyst.

The charge transporting substances of the present invention have such an advantage that they can effectively constitute photosensitive elements for electrophotography in combination with any member selected from among a variety of charge generating substances.

As the charge generating substances which are usable in the present invention, there may be mentioned, for example, those as illustrated below.

(1) Selenium and selenium alloys (2) Inorganic photoconductive substances such as CdS, CdSe, CdSSe, ZnO and ZnS
(3) Phthalocyanine pigments such as metal phthalocyanine and non-metal phthalocyanine
(4) Azo dyes such as monoazo dyes and dis-azo dyes
(5) Perylene type pigments such as anhydrides of perylene tetracarboxylic acid and perylene tetracarboxylic acid diimide
(6) Indigoid dyes
(7) Quinacridone pigments
(8) Polycyclic quinones such as anthraquinones, pyrenequinones and flavanthrones
(9) Bisbenzimidazole pigments
(10) Cyanine dyes
(11) Squarylium dyes
(12) Indanthrone type pigments
(13) Xanthene dyes
(14) Charge-transfer complexes consisting of electrondonating substances, e.g. poly-N-vinylcarbazole, and electron-accepting substances, e.g. trinitrofluorenone, and
(15) Co-crystalline complexes formed from pyrilium salt dyes and polycarbonate resins.

Preferably usable as the polymeric binders in the photosensitive elements are film-forming high polymers which are hydrophobic, in high dielectric constant and electrically insulated. Such high polymers include, for example, those as illustrated below.

(1) Polystyrene resins
(2) Polyvinyl chloride resins
(3) Polyvinylidene chloride resins
(4) Polyvinyl acetate resins
(5) Acrylic resins
(6) Methacrylic resins
(7) Styrene-butadiene copolymers
(8) Vinylidene chloride-acrylonitrile copolymers
(9) Vinyl chloride-vinyl acetate copolymers
(10) Silicone resins
(11) Polyester resins
(12) Polycarbonate resins
(13) Styrene-alkyd resins
(14) Silicone-alkyd resins, and
(15) Phenolformaldehyde resins.

Figure 2:
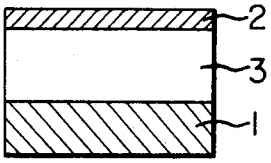
Figure 3:
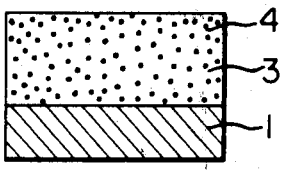
Figure 4:
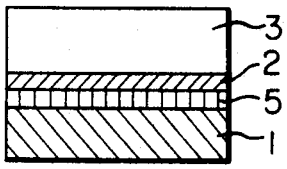
Figure 5:
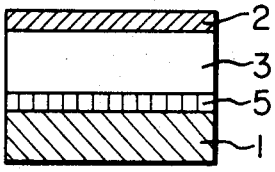
Figure 6:
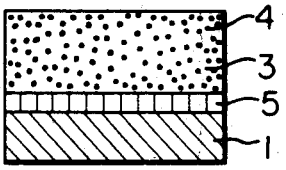

The accompanying FIGS. 1 to 6 are to show a variety of embodiments of the photosensitive elements for electrophotography according to the present invention, wherein 1 represents a conductive support, 2 represents a charge generating layer, 3 represents a charge transporting layer, 4 represents a fine particle of a charge generating substance, and 5 represents an intermediate layer acting as an adhesive layer or a barriering layer.

As shown in the accompanying FIGS. 1, 2, 4 and 5, the photosensitive elements of the present invention fundamentally have a double layer structure, wherein a thin layer 2 comprising a charge generating substance is formed, if necessary through an intermediate layer 5, on a conductive support 1 and adjacent to the thus formed thin layer 2 is provided a layer 3 comprising a charge transporting substance. Photosensitive elements with most excellent electrophotographic characteristics are obtained when they are so designed as to have the double layer structure mentioned above. However, as shown in the accompanying FIGS. 3 and 6, effectively usable as photosensitive elements in the present invention as well are those having such a structure that fine particles 4 of a charge generating substance have previously been dispersed in a coating solution comprising a charge transporting substance, and the coating solution is coated, if necessary through an intermediate layer 5, on a conductive support 1 to form a layer 3 consisting essentially of the charge transporting substance and the charge generating substance.

In the case of the present photosensitive elements having the double layer structure, moreover, whether or not the charge generating layer 2 is superposed on the charge transporting layer 3 or vice versa is decided according to selection of the charged polarity, positive or negative. That is, it is of advantage to use the charge transporting layer 3 as an upper layer in the case the selected charge is negative. This is ascribable to the fact that the pyrazoline compounds of the present invention dominantly exhibit a preference for positive charge transfer.

In the case of preparing the present photosensitive elements having the double layer structure which have a charge generating layer comprising a charge generating substance and a charge transporting layer comprising a charge transporting substance, the charge generating layer can be provided directly on a conductive support or on the charge transporting layer, and if necessary on an intermediate layer such as an adhesion layer or barriering layer to be further provided, by means of (1) vacuum evaporation of the charge generating substance,
(2) coating thereon a solution for the charge generating substance in an appropriate solvent, or
(3) coating thereon a dispersion prepared by finely pulverizing and dispersing the charge generating substance with a ball mill, homogenizer or the like in a dispersing medium and, if necessary mixing the resulting dispersing with a polymeric binder similar to those used in the charge transporting layer.

The charge generating layer is preferably provided so as to have a thickness of from 0.05 to 5 $\mu$m, more preferably from 0.1 to 3 $\mu$m.

Most preferably, the charge transporting layer is provided so as to have a thickness of from 5 to 30 $\mu$m, though it may greatly varied depending upon circumstances.

In the case where no double layer structure is adopted, but a single layer is formed, wherein fine particles of the charge generating substance have previously been dispersed in a coating solution for the charge transporting substance and the coating solution is applied to form the charge transporting layer singly, the thickness of this singly layer is most preferably from 5 to 30 $\mu$m, as well.

In forming a layer comprising the pyrazoline compound of the present invention, it is preferable to use, together with the compound, a polymeric binder, and then the amount of the polymeric binder in the layer are preferably 0.8–5 parts by weight based on 1 part by weight of the charge transporting substance, and in the case of the aforesaid single layer structure, the amounts of the polymeric binder and charge generating substance are preferably 0.8 to 4 parts by weight and 0.1 to 2 parts by weight, respectively, based on 1 part by weight of the charge transporting substance.

Furthermore, when the charge inducing layer is provided in the form of a dispersion system with a polymeric binder, it is preferable to use the polymeric binder in an amount in the range of less than 10 part by weight based on 1 part by weight of the charge generating substance present in the dispersion system.

One of unexpected advantages of the present invention is that the pyrazoline compounds according to the invention may be used either singly or in admixture of two or more.

Usable as conductive supports in the present invention include sheets of paper or plastic film which have been made conductive by attaching thereto metal foils, conductive compounds or the like, or metal plates plated with palladium or the like. Usable intermediate layers comprises polymeric binder such as gelatin, casein, starch, polyvinyl alcohol, vinyl acetate, ethylcellulose, carboxymethylcellulose and the like, or aluminium oxide thin layers.

The photosensitive elements of the present invention prepared in the manner explained above are excellent in charge characteristics, photosensitivity and image characteristics, and can exhibit when used in multitransfer electrophotography such effects that they are less in fatigue and deterioration due to repeated use and excellent in printing endurance.

The present invention is illustrated below more concretely with reference to examples, but it should be construed that embodiments of the invention are not limited to these examples.

EXAMPLE 1

On an aluminium-evaporated polyester support base was provided by evaporation an amorphous selenium layer having a thickness of 0.5μ as a charge generating layer and thereon was then coated a solution of 1 part by weight of a polycarbonate resin (Panlite L-1250 produced by Teijin Co., Ltd.) and 0.6 part by weight of exemplified compound (1) in 16 parts by weight of dichloromethane to form a charge transporting layer having a dry film thickness of 8μ. Upon drying at 40° C. for 10 hours, there was obtained a sample of the present photosensitive element having on the base a homogeneous and transparent photosensitive film. This sample was charged for 5 seconds at a charging voltage of 6" KV using SP-428 Rotary Sector type electrostatic paper analizer (manufactured by Kawaguchi Denki Co., Ltd.), whereupon the surface potential as measured was −730 volts. After standing for 5 seconds in a dark place, the sample was measured to have the surface potential of −510 volts. Upon measurement of an exposure amount necessary for decaying the surface potential to half (half decay exposure) under irradiation with a halogen lamp, the half decay exposure was found to be 9.4 lux.sec.

On the other hand, a comparative photosensitive element was prepared in the same manner as in the case of the above-mentioned sample, except that the undermentioned pyrazoline compound disclosed in U.S. Pat. No. 3,837,851 in place of the exemplified compound (1), and was tested in comparison with the sample of the present photosensitive element. That is, on an aluminum-evaporated polyester base was provided by evaporation an amorphous selenium layer having a thickness of 0.5μ and thereon was then coated a solution of 1 part by weight of a polycarbonate resin (Panlite L-1250 produced by Teijin Co., Ltd) and 0.6 part by weight of 1-phenyl-3-(p-dimethylaminostyryl)-5-(p-dimethylaminophenyl)pyrazoline in 16 parts by weight of dichloromethane to form a charge transporting layer having a dry film thickness of 8μ, followed by drying at 40° C. for 10 hours to prepare the comparative sample of photosensitive elements. In the case of this comparative sample, however, parts of the pyrazoline compound deposited on the element surface and no homogeneous photosensitive film was obtained. Upon measurement of this comparative sample under the same conditions as in the case of the present sample, the surface potential charged at 6 KV for 5 seconds was found to be as low as −220 volts, and the surface potential as measured after standing for 5 seconds in a dark place was −90 volts. In comparison with the present photosensitive element, thus the comparative photosensitive element was markedly low in accepting potential and extremely large in dark decay.

EXAMPLE 2

A sample of a photosensitive element of the double layer structure was prepared in the same manner as in the sample of the present invention of Example 1, except that exemplified compound (4) was used in place of the exemplified compound (1). The sample thus prepared was measured in potential characteristics in the same procedure as in Example 1, whereupon the half decay exposure of the sample when negatively charged was 7.9 lux Sec.

EXAMPLE 3

On an aluminum-evaporated base was coated a n-butylamine solution of Diane Blue (C.I. No.-21180) so as to form a charge generating layer having a dry film thickness of 1μ. On this layer was then coated a solution of 1 part by weight of a polycarbonate resin (Panlite L-1250 produced by Teijin Co., Ltd.) and 0.5 part by weight of exemplified compound (3) in 14 parts by weight of dichloromethane so as to form a charge generating layer having a dry film thickness of 10μ. After drying at 50° C. for 10 hours, the photosensitive element as prepared was negatively charged and then measured in the same manner as in Example 1, whereupon the half decay exposure obtained was 2.2 lux.sec.

EXAMPLE 4

On the charge generating layer of Example 3 was coated a solution of 0.8 part by weight of a polycarbonate (Jupilon S-1,000 produced by Mitsubishi Gas Chemical Co., Ltd.), 0.2 part by weight of a methacrylic resin (Acrypet produced by Mitsubishi Rayon Co., Ltd.), 0.25 part by weight of exemplified compound (4) and 0.25 part by weight of exemplified compound (5) in 12 parts by weight of dichloromethane to form a charge transporting layer having a dry film thickness of 12μ, followed by drying at 50° C. for 10 hours. This photosensitive element was subjected reproduction of image using a copying machine U-Bix 2000R (manufactured by Konishiroku Photo Industry Co., Ltd.) to obtain image copies high in contrast, faithful to the original free from fog and sharp, and no charge was observed even when thhe reproduction was repeated 20,000 times.

EXAMPLE 5

A photosensitive element was prepared in the same manner as in Example 1 except that the charge generating layer was formed by evaporation of 4,4',7,7'-tetrachlorothioindigo (Bordeaux RN C.I. No.-73312 produced by Chiba-Geigy) so as to have a thickness of 0.5μ and exemplified compound (3) was used in the charge transporting layer. The half decay exposure of the thus prepared element as measured was 2.6 lux.sec.

EXAMPLE 6

On an aluminum-evaporated polyester base was coated a coating liquid prepared by pulverizing a mixture comprising 2.5 parts by weight of $\beta$-type copper phthalocyanine, 1 part by weight of a polyester (Vylon 200 produced by Toyobo Co., Ltd.) and 30 parts by weight of tetrahydrofuran by means of a ball mill so as to have a dry film thickness of 0.6$\mu$. On the layer thus formed was coated a solution of 1 part by weight of a polycarbonate (Panlite L-1250 produced by Teijin Co., Ltd.) and 0.5 part by weight of exemplified compound (2) in 14 parts by weight of dichloromethane to form a charge transporting layer so as to have a dry film thickness of 10$\mu$.

The half decay exposure of the thus obtained photosensitive element as measured was 6.3 lux.sec.

From the results obtained in Examples 2 to 6 as illustrated above, it is understood that the photosensitive elements of the present invention are of high sensitivity as compared with the comparative photosensitive element (a known photosensitive element) of Example 1.

EXAMPLE 7

A mixture comprising 0.25 part by weight of cadmium sulfide, 1 part by weight of a polyester (Polyester Adhesive 49000 produced by Du Pont) and 20 parts by weight of tetrahydrofuran was dispersed for 24 hours by means of a ball mill to prepare a dispersion. To this dispersion was then dissolved 0.5 part by weight of exemplified compound (8), and the resulting solution was coated on an aluminum-evaporated polyester base to form a layer having a dry film thickness of 11$\mu$. The half decay exposure of the thus obtained photosensitive element as measured was 7.2 lux.sec.

On the other hand, a comparative photosensitive element was prepared in the same manner as in the case of the present photosensitive element mentioned above, except that the under-mentioned pyrazoline compound disclosed in U.S. Pat. No. 3,837,851 was used in place of the exemplified compound (8), and the comparative sample thus prepared was tested in comparison with the present sample.

That is, a mixture comprising 0.25 part by weight of cadmium sulfide, 1 part by weight of a polyester (Polyester Adhesive 49000 produced by Du Pont), and 20 parts by weight of tetrahydrofuran was dispersed for 24 hours by means of a ball mill to prepare a dispersion. To this dispersion was then dissolved 0.5 part by weight of 1-phenyl-3-(p-methoxystyryl)-5-(p-methoxyphenyl-pyrazoline, and the resulting solution was coated on an aluminum-evaporated polyester base to form a layer having a dry film thickness of 11$\mu$. The half decay exposure of the thus obtained comparative photosensitive element as measured was 12 lux.sec., and thus the comparative photosensitive element was markedly low in sensitivity as compared with the present photosensitive element.

What we claim is:

1. A photosensitive element for electrophotography which element comprises a conductive support, a charge generating layer containing a charge generating substance, and a charge transporting layer; said charge transporting layer comprising a polymeric binder containing a charge transporting substance represented by the following general formula

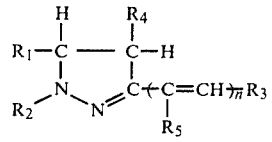

wherein n represents 0 or 1, $R_1$, $R_2$ and $R_3$ each represent an aryl group, and $R_4$ and $R_5$ each represent a hydrogen, an alkyl group having 1–4 carbon atoms, an aryl group or an aralkyl group, provided that $R_4$ and $R_5$ are not simultaneously a hydrogen, and when n is 0, $R_4$ is not hydrogen.

2. A photosensitive element according to claim 1 wherein an aryl group for $R_1$, $R_2$ and $R_3$ is a phenyl group.

3. A photosensitive element according to claim 1 wherein the charge transporting substance represented by the following general formula (II).

General formula [II]

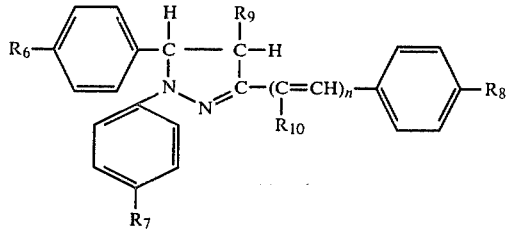

wherein n represents 0 or 1, $R_6$, $R_7$ and $R_8$ each represent a hydrogen, an amino, a dialkylamino, a diarylamino, a diaralkylamino or an alkoxy, and $R_9$ and $R_{10}$ each represent a hydrogen, an alkyl having 1–4 carbon atoms, an aryl group or an aralkyl group, provided that $R_9$ and $R_{10}$ are not simultaneously a hydrogen, and when n is 0, $R_9$ is not a hydrogen.

4. A photosensitive element according to claim 1 wherein the charge generating substance is an organic dye or an organic pigment.

5. A photosensitive element according to claim 1 wherein the charge generating substance is an inorganic photoconductor.

6. A photosensitive element according to claim 1 wherein the polymeric binder is selected from the group consisting of acrylic resins, methacrylic resins, polycarbonate resins, polyester resins, vinyl chloride-vinyl acetate copolymers, vinylidene chloride-acrylonitrile copolymers, polyvinyl chloride resins and polyvinylidene chloride resins.

7. A photosensitive element according to claim 1 wherein the charge transporting layer is adjacent thereto the charge generating layer, and the former is thicker than the latter.

8. A photosensitive element according to claim 1 wherein the charge transporting substance is present in the charge transporting layer in a dispersed state.

* * * * *